US007056097B2

(12) United States Patent
Lake

(10) Patent No.: US 7,056,097 B2
(45) Date of Patent: Jun. 6, 2006

(54) SYSTEM AND METHOD FOR MONITORING THE MECHANICAL CONDITION OF A RECIPROCATING COMPRESSOR

(75) Inventor: Andrew W. Lake, Alvin, TX (US)

(73) Assignee: Equistar Chemicals L.P., Houston, TX (US)

( * ) Notice: Subject to any disclaimer, the term of this patent is extended or adjusted under 35 U.S.C. 154(b) by 441 days.

(21) Appl. No.: 10/630,053

(22) Filed: Jul. 30, 2003

(65) Prior Publication Data

US 2005/0025631 A1 Feb. 3, 2005

(51) Int. Cl.
*F04B 49/00* (2006.01)

(52) U.S. Cl. ..... 417/63

(58) Field of Classification Search ..... 417/63; 73/862.543, 168, 862.541, 862.542; 702/114
See application file for complete search history.

(56) References Cited

U.S. PATENT DOCUMENTS 4,456,963 A 6/1984 Wiggins
4,669,960 A * 6/1987 Allen et al. ..... 417/63
5,038,893 A * 8/1991 Willner et al. ..... 184/7.4
5,882,384 A 3/1999 Tom et al.
5,931,044 A * 8/1999 Robert ..... 73/168
6,216,300 B1 * 4/2001 Hannagan ..... 5/713
6,292,757 B1 * 9/2001 Flanagan et al. ..... 702/138
6,494,343 B1 12/2002 McManus et al.

* cited by examiner

*Primary Examiner*—Charles G. Freay
*Assistant Examiner*—Vikansha Dwivedi
(74) *Attorney, Agent, or Firm*—Brooks Kushman P.C.

(57) ABSTRACT

A method for monitoring the mechanical condition of a reciprocating compressor having a packed-plunger cylinder is provided. An end assembly is attached to one end of the cylinder, and the strain of at least one component of the end assembly is measured as the plunger reciprocates within the cylinder. The measured strain is correlated with a crank angle to facilitate generation of a strain profile. Two pressure values related to the pressure in the cylinder are determined when the plunger is at two different locations. This facilitates generation of a cylinder pressure profile based on the correlated measured strain. The cylinder pressure profile is thus generated without the use of intrusive gauges or sensors, which may create a leak path, or create a stress concentration in the wall of the cylinder.

20 Claims, 6 Drawing Sheets

SYSTEM AND METHOD FOR MONITORING THE MECHANICAL CONDITION OF A RECIPROCATING COMPRESSOR

BACKGROUND OF THE INVENTION

1. Field of the Invention

The present invention relates to a system and method for monitoring the mechanical condition of a reciprocating compressor.

2. Background Art

The production of low density polyethylene requires the use of very high pressures. In fact, polymerization pressures can reach as high as 50,000 pounds per square inch (psi). To achieve these pressures, high pressure reciprocating compressors, or hypercompressors, are used. Hypercompressors typically use "packed-plunger" cylinders of either "pressure-wrapped" or "tie-rod" construction. Monitoring the mechanical condition of the cylinder components during operation of the compressor is important for determining maintenance requirements.

An important parameter in monitoring the mechanical condition of a reciprocating compressor is the internal pressure. By monitoring the internal pressure of the cylinder, several parameters can be analyzed to determine if any of the cylinder components are deficient. By identifying a deficiency, preventative maintenance can be scheduled, and performed at a convenient time to minimize production downtime. The internal pressure of a cylinder in a hypercompressor may be difficult to obtain, since the ultrahigh pressure within the cylinder prohibits a direct measurement. Thus, a need exists for a non-intrusive pressure measurement technique that will provide information about the internal pressure of a cylinder in a hypercompressor that will facilitate monitoring the mechanical condition of the compressor.

One type of non-intrusive pressure measurement is described in U.S. Pat. No. 6,494,343, issued to McManus et al. on Dec. 17, 2002. McManus et al. discusses the use of a strain responsive sensor disposed on a exterior portion of a pressure vessel. Known relationships between the stress and strain of a thin-walled pressure vessel are then used to calculate the internal pressure of the vessel based on the external strain measured by the strain gauge. One limitation of the system described in McManus et al. is that the thin-walled pressure vessel equations are not applicable to a relatively thick-walled cylinder, such as a packed-plunger cylinder used in a hypercompressor. In addition, the pressure within the hypercompressor cylinder is not constant, but rather, it varies cyclically based on the reciprocating motions of a plunger. Therefore, a need still exists for a non-intrusive pressure monitoring system and method that can be effectively used with a packed-plunger cylinder in a hypercompressor.

U.S. Pat. No. 4,456,963, issued to Wiggins on Jun. 26, 1984, describes an apparatus and method for measuring performance characteristics of a reciprocating piston engine or compressor. The Wiggins apparatus uses a pressure transducer that is attached to the engine/compressor cylinder through an indicator valve. The pressure transducer may be a strain gauge type transducer that provides a voltage signal to an output device, such as an oscilloscope. Rather than calibrating output from the transducer with a known internal pressure, the Wiggins apparatus uses a known relationship between the full scale pressure range of the pressure transducer and the sensitivity of the pressure transducer. Once converted, the output from the pressure transducer may be displayed with respect to a crankshaft angle of the engine/compressor.

One limitation of the Wiggins apparatus and method is that it does not provide for a non-intrusive pressure measurement, which is desirable when working with hypercompressors. The use of an indicator valve in a compressor cylinder, such as described in Wiggins, would not only create a potential leak path, but could add significantly to the cylinder stress. Therefore, a need still exists for a system and method for monitoring the mechanical condition of a hypercompressor, and in particular for non-intrusively monitoring the pressure of a packed-plunger cylinder in the compressor.

SUMMARY OF THE INVENTION

A method of monitoring the mechanical condition of a reciprocating compressor having a pressure-wrapped cylinder is provided. The compressor includes a plunger, operable to reciprocate within the cylinder to cyclically compress a working fluid, thereby increasing the pressure of the fluid. The compressor also includes an end assembly attached to one end of the cylinder, and at least one valve operable to facilitate fluid transfer between the cylinder and a source external to the cylinder. The method comprises measuring strain of at least one component of the end assembly as the plunger reciprocates within the cylinder. The at least one end assembly component experiences a variable compressive force when the plunger reciprocates within the cylinder. The measured strain is correlated with a parameter related to plunger location, thereby facilitating generation of a strain profile. First and second pressure values are determined. The first and second pressure values are related to the pressure in the cylinder when the plunger is at first and second locations, respectively. This facilitates generation of a cylinder pressure profile based on the correlated measured strain.

DETAILED DESCRIPTION OF THE PREFERRED EMBODIMENT(S)

Figure 1:
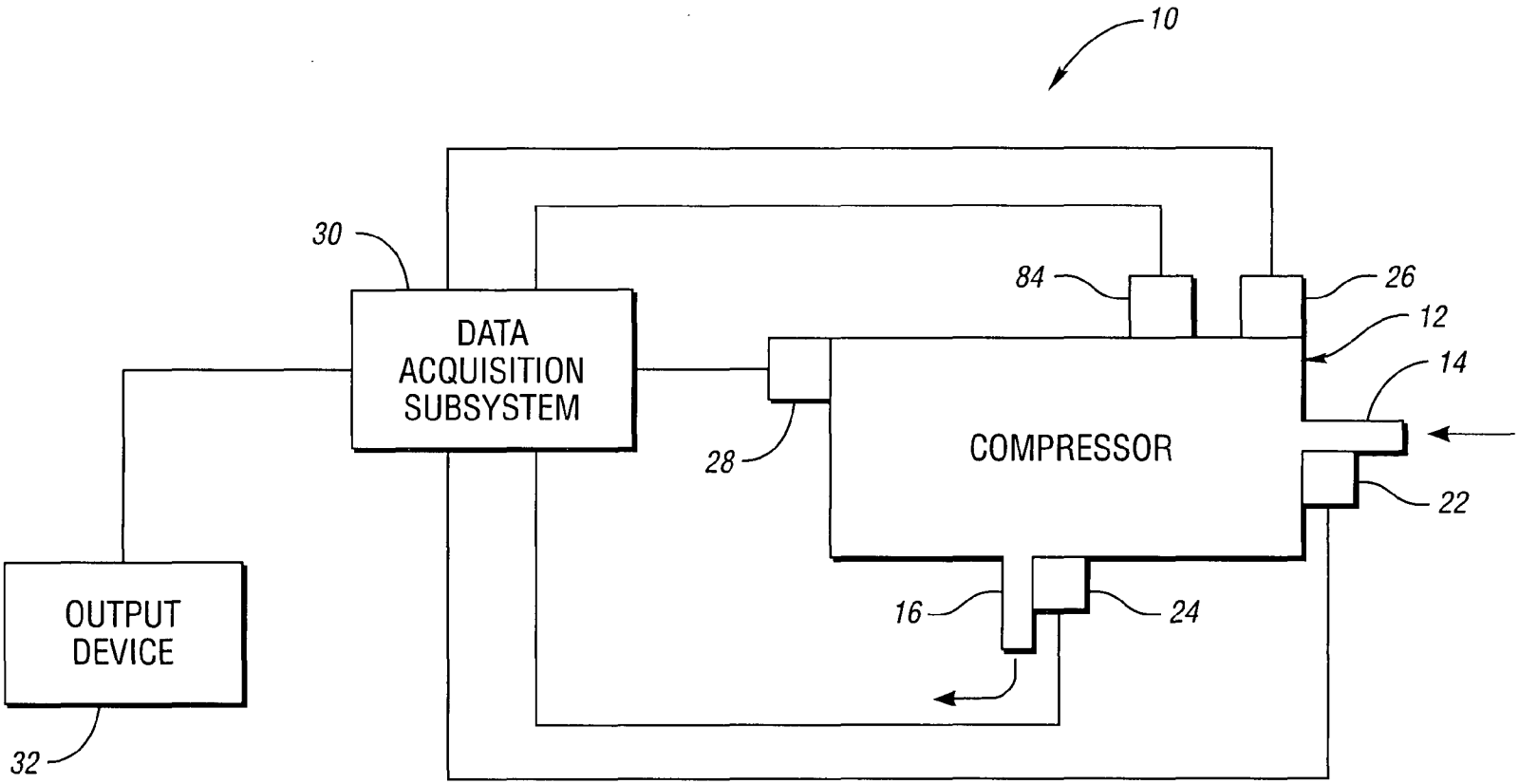
FIG. 1 is a schematic representation of a system in accordance with the present invention.

FIG. 1 shows a basic schematic representation of a system 10 in accordance with the present invention. The system 10 includes a reciprocating compressor 12 having a suction line 14 and a discharge line 16. As explained in more detail below, the compressor 12 includes two packed-plunger, or pressure-wrapped cylinders 18, 20 (see FIG. 2). Returning to FIG. 1, the system 10 also includes a number of sensors 22, 24, 26 and 28, configured to perform various measurements and send output to a data acquisition subsystem (DAS) 30. The DAS 30 may include a computer having one or more processors, and capable of applying preprogrammed algorithms to data input from various sensors, such as the sensors 22, 24, 26, 28. An output device 32 is in communication with the data acquisition subsystem 30, and may include a printer, a monitor, another computer, or any device configured to output information from the data acquisition subsystem 30 in a useful form.

Figure 2:
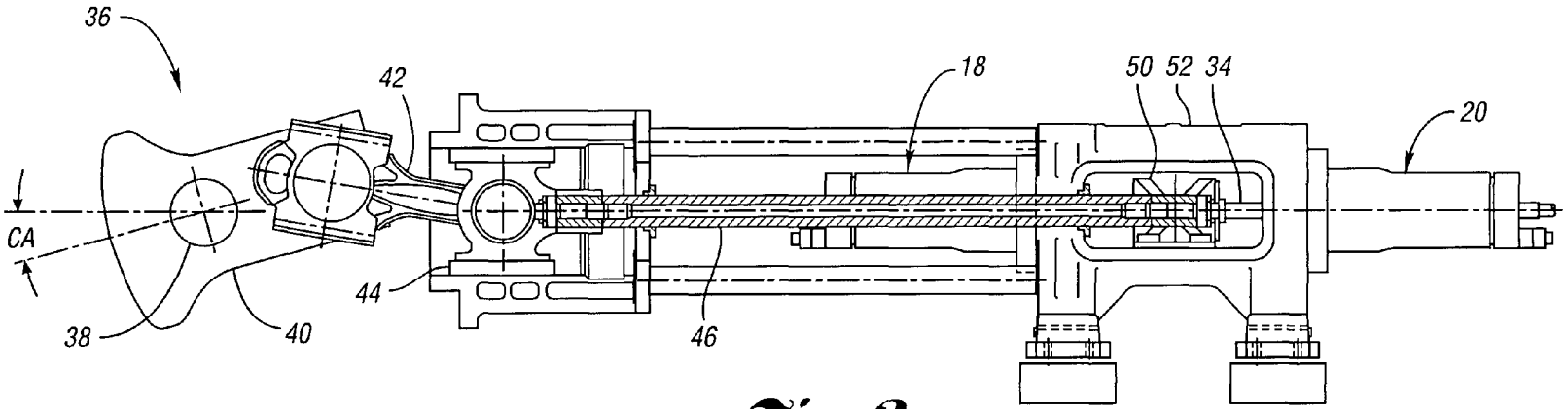
FIG. 2 is a partial sectional side view of portion of a reciprocating compressor having a pressure-wrapped cylinder.
Figure 3:
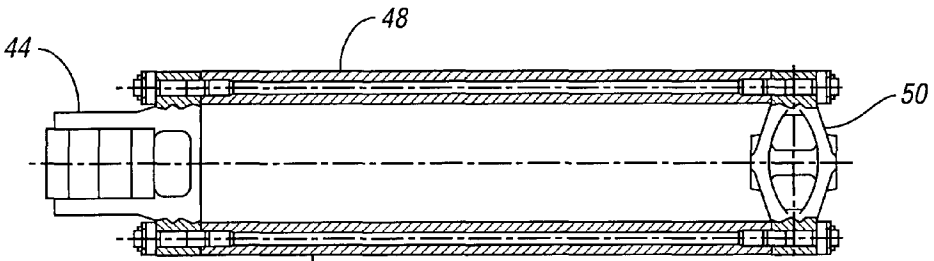
FIG. 3 is a top view of a portion of the compressor shown in FIG. 2, wherein some components have been removed for clarity.

FIG. 2 shows a more detailed view of the compressor 12. Cylinders 18, 20 each have a plunger, though in FIG. 2, only the plunger 34 for cylinder 20 is visible. The plungers are operable to reciprocate within each cylinder 18, 20 to cyclically compress a working fluid, such as a gas. This increases the pressure of the fluid, which is primary function of a compressor, such as the compressor 12. A crank assembly 36 is configured to cooperate with the plungers to transform rotational motion of a crankshaft 38 into the reciprocating motion of the plungers. The crank assembly 36 includes a crank 40, rotatably connected to the crankshaft 38. The crank assembly 36 also includes a connecting rod 42 and a cross head 44 which cooperate with the crank 40 in a standard slider-crank configuration. Connected to the cross head 44 are two drive rods 46, 48 (see also FIG. 3). The drive rods 46, 48 transfer the reciprocating linear motion of the cross head 44 to an auxiliary cross head, or drive yoke 50. The drive yoke 50 is connected to the plungers of both cylinders 18, 20 in what is known as an opposed plunger arrangement. The drive yoke 50 is supported by a pedestal 52, which has the cylinders 18, 20 securely bolted to it.

Figure 4:
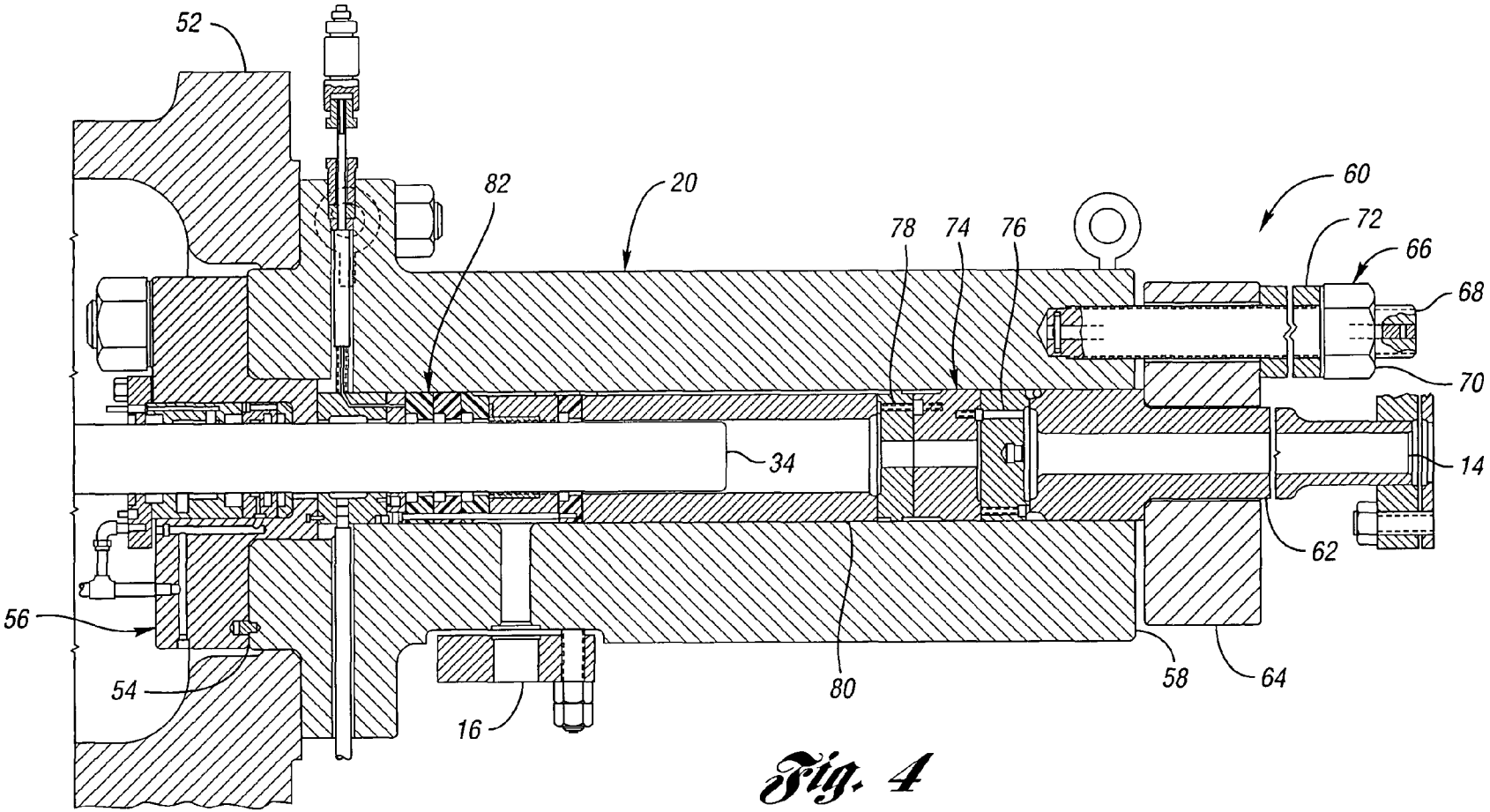
FIG. 4 is a partial sectional view of a pressure-wrapped cylinder used in the compressor shown in FIG. 2.

A sectional view of the cylinder 20 is shown in FIG. 4. A first end, or bottom end 54, of the cylinder 20 has attached to it a frame end plug 56. A second end, or outer end 58, of the cylinder 20, cooperates with an end assembly 60 for allowing intake of fluid into the cylinder 20. The end assembly 60 includes a head 62 which is partially disposed within the cylinder 20, and configured to facilitate fluid flow into the cylinder 20 through the suction line 14. The end assembly 60 also includes a flange 64 circumferentially disposed around a portion of the head 62, and bolted to the cylinder 20 with a stud subassembly 66. The stud subassembly 66 includes a stud 68, a locking nut 70, and a spacer 72. Although only one stud assembly 66 is shown in FIG. 4, a number of such stud assemblies will be circumferentially disposed around the cylinder axis to secure the flange 64 adjacent to the outer cylinder end 58. The flange 64 retains the head 62 at least partially within the cylinder 20.

The cylinder 20 includes a multiple poppet valve 74 which facilitates suction and discharge of fluid, into and out of the cylinder 20. Of course, cylinders, such as the cylinder 20, may have poppet elements, with at least one poppet that is configured to facilitate suction of the working fluid, while at least one other poppet is configured to facilitate discharge of the working fluid. As the working fluid enters the cylinder through the suction line 14, the head 62, and a suction portion 76 of the valve 74, it is taken into the cylinder 20, where it is compressed by the plunger 34. The compressed fluid then flows through a discharge portion 78 of the valve 74, and flows around the outside of a sleeve 80 disposed within the cylinder 20. The fluid then flows around a packing assembly 82, and leaves the cylinder through the discharge line 16.

In order to facilitate monitoring of the mechanical condition of the compressor 12, the system 10 is configured to provide inputs to the data acquisition subsystem 30 which applies a preprogrammed algorithm (or algorithms) to the inputs, and sends the output to the output device 32. For example, the sensors 22, 24, shown schematically in FIG. 1, are pressure sensors configured to measure the pressure of the working fluid in the suction line 14 and the discharge line 16, respectively. The pressure sensors 22, 24 then signal the data acquisition subsystem 30 so that the measured pressures may be used in the preprogrammed algorithm. Direct measurement of the suction line pressure and the discharge line pressure can be used to determine first and second pressure values. The first and second pressure values are related to the pressure in the cylinder 20 when the plunger is at first and second locations, respectively. Specifically, the pressure in the suction line 14, as measured by the pressure sensor 22, can be used as an estimate of the pressure in the cylinder 20 when the plunger is at bottom dead center (BDC). In addition, the pressure in the discharge line 16, as measured by the pressure sensor 24, can be used as an estimate of the pressure inside the cylinder 20 when the plunger 34 is at top dead center (TDC). As explained more fully below, determining two pressure values related to the pressure in the cylinder when the plunger is at two different locations, helps to facilitate generation of a cylinder pressure profile by the method of the present invention. Of course, other pressure measurements or other estimates of cylinder pressure may be used; however, direct measurement of the suction line pressure and the discharge line pressure provides a convenient mechanism for determining the first and second pressure values.

Figure 5:
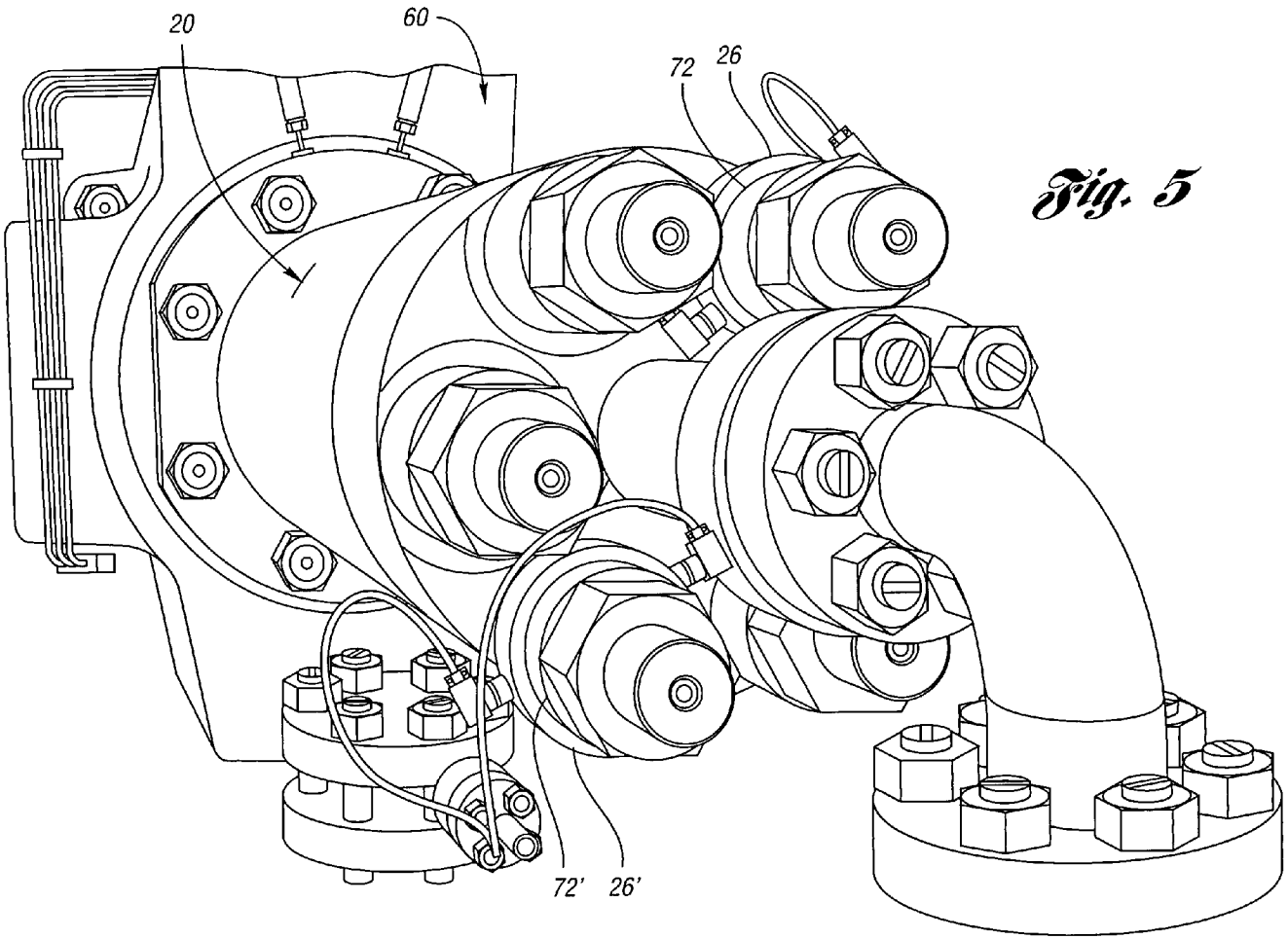
FIG. 5 is a perspective view of the outside of the cylinder shown in FIG. 4.

The sensor 26, shown schematically in FIG. 1, is a strain gauge configured to measure the strain of one of the components of the end assembly 60, and to output a signal related to the measured strain to the data acquisition subsystem 30. As shown in FIG. 5, the strain gauge 26 may be a ring gauge circumferentially disposed on one of the end assembly components, such as the spacer 72. Because of the configuration of the cylinder 20 and the end assembly 60, the spacer 72 experiences a variable compressive force when the plunger 34 reciprocates within the cylinder 20. Thus, as the pressure within the cylinder 20 increases, the spacer 72 will experience an increased compressive force, which will translate into a measurable strain. As shown in FIG. 5, the end assembly 60 is configured with two strain gauges 26, 26' that are circumferentially disposed on two spacers 72, 72'. Each of the strain gauges 26, 26' is configured to send signals to the data acquisition subsystem 30, where the preprogrammed algorithm can mathematically combine the two measured strains into a single value. This provides a mechanism for compensating for strains that are not associated with cylinder pressure, but that may be inadvertently measured by one of the strain gauges 26, 26'. Although not visible in the drawing figures, it is contemplated that the cylinder 18 will also have two strain gauges attached to an end assembly.

In order to evaluate the change in strain as measured by the strain gauge 26 (and the strain gauge 26'), it is useful to determine a parameter related to the location of the plunger 34 within the cylinder 20 so that the measured strain can be plotted as a function of the plunger location. One way to determine the location of the plunger 34 within the cylinder 20 would be to measure the location of the drive rods 46, 48, since their movement is directly related to the movement of the plunger 34. Another way to determine the plunger location is to measure the crank angle (CA), which is the angle the crank 40 makes with an axis directed from the center of the crankshaft 38 to the center of the cross head 44 (see FIG. 2). The crank angle can be measured in a number of ways. For example, the sensor 28, shown schematically in FIG. 1, may represent a subsystem configured to determine the crank angle and to output a signal to the data acquisition subsystem 30 related to the crank angle. The subsystem 28 may include such measurement systems as a proximity probe configured to detect a discontinuity in the crankshaft 38, or it could include a magnetic pickup configured to detect a magnetic device disposed on the crankshaft 38.

These are just two examples of different measurement systems that may be used to determine the position of the plungers of the cylinders 18, 20.

Using the preprogrammed algorithm, the data acquisition subsystem 30 can correlate the strain measured by the strain gauges 26, 26' with a plunger location parameter, such as the crank angle, to facilitate generation of a strain profile. Thus, the data acquisition subsystem 30 could send information to the output device 32 to generate a graph wherein the strain measured by the strain gauges 26, 26' was shown on the Y-axis, and the crank angle, or other plunger location parameter, was shown on the X-axis. Such a strain profile, however, may not be as desirable as a pressure profile for monitoring the mechanical condition of a compressor, such as the compressor 12. Thus, the preprogrammed algorithm in the data acquisition subsystem 30 is also configured to use the suction line pressure and discharge line pressure measured by the pressure sensors 22, 24, respectively, in order to generate a cylinder pressure profile. Specifically, it is assumed that the pressure inside the cylinder 20 at TDC equals the discharge line pressure, and the pressure inside the cylinder 20 at BDC equals the suction line pressure. The preprogrammed algorithm then matches the strains that were measured when the plunger was at TDC and BDC with the corresponding measured pressures. This provides a mechanism for correlating the measured strain with the cylinder pressure. Moreover, because two different pressures are known, a pressure scale can be determined and applied to a graph, for example, along the Y-axis. Thus, the system 10 provides for the generation of a cylinder pressure profile using a completely nonintrusive technique.

Also shown in FIG. 1 is another sensor 84 which is configured to sense vibrations of the poppet valve 74, and to output a signal related to the sensed vibrations to the data acquisition subsystem 30. In this way, the preprogrammed algorithm in the data acquisition subsystem 30 can further correlate the vibrations of the poppet valve 74 with the location of the plunger 34 such that a graph may be generated showing both a cylinder pressure profile and a valve vibration trace, thereby providing a powerful diagnostic tool to monitor the mechanical condition of a compressor, such as the compressor 12. Examples of such a graph is shown in FIG. 6, and described in more detail below.

Figure 6:
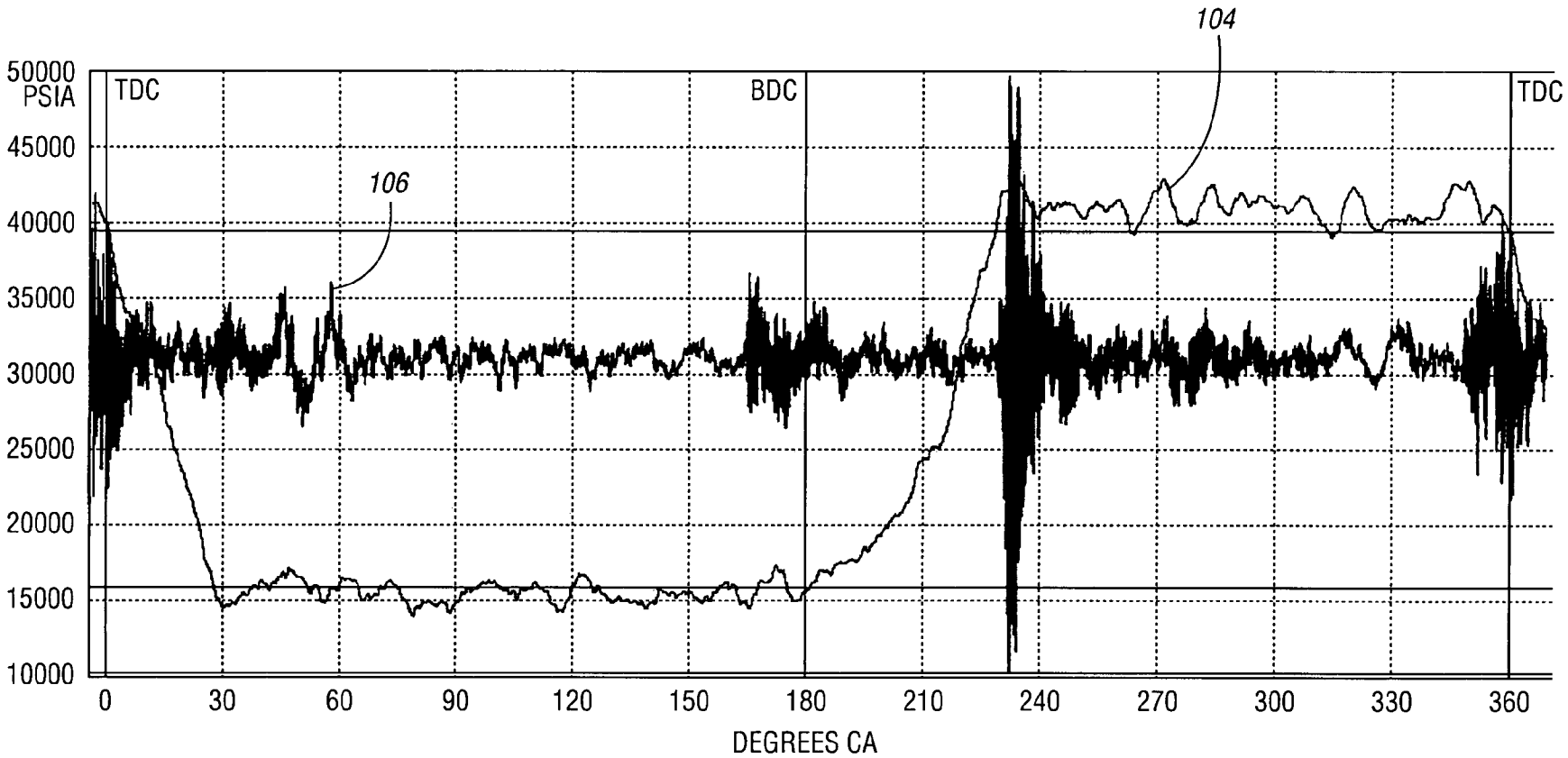
FIG. 6 is pressure profile and vibration trace generated using the system and method of the present invention.
Figure 7:
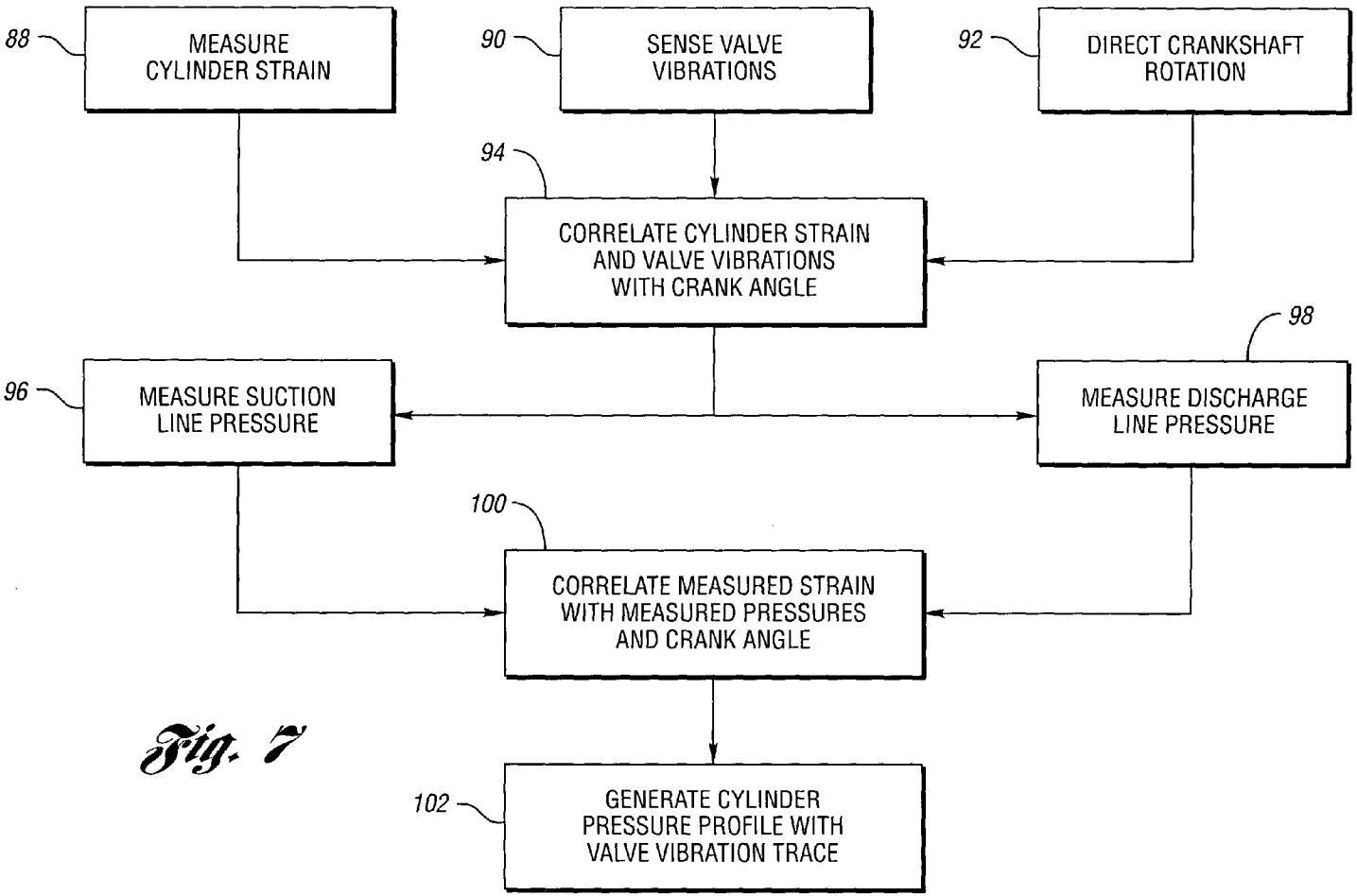
FIG. 7 is a flowchart illustrating a method in accordance with the present invention.

FIG. 7 is a flowchart 86 illustrating a method of using the system 10 to provide the output shown in FIG. 6. In step 88, the cylinder strain is measured by strain gauges 26, 26'. At the same time, in step 90, the vibrations of the poppet valve 74 are measured by the vibration sensor 84. In addition, the position of the plunger 34 is measured by the subsystem 28, which is configured to detect rotation of the crankshaft 38. Inputs based on each of these measurements are then provided to the data acquisition subsystem 30, which correlates the cylinder strain and the valve vibrations with the crank angle, see step 94. Steps 96 and 98 include measuring the suction line pressure and the discharge line pressure, respectively. Although these steps are shown chronologically after steps 88–94, they may take place before, or simultaneously with, one or more of the previously described steps. Once the suction and discharge line pressures are known, the data acquisition subsystem 30 can then use the preprogrammed algorithm to correlate the measured strain with the measured pressures and the crank angle, see step 100. Finally, in step 102, the data acquisition subsystem 30 sends information to the output device 32 to generate a cylinder pressure profile with a valve vibration trace on the same graph.

FIG. 6 illustrates a pressure profile 104 using the system and method of the present invention. A vibration trace 106 is also included on the graph, and by using the preprogrammed algorithm in the data acquisition subsystem 30, the pressure profile 104 and vibration trace 106 have been synchronized according to the crank angle, shown along the X-axis of the graph. The graph shown in FIG. 6 can be used by one skilled in the art of monitoring the mechanical condition of a reciprocating compressor, such as the compressor 12. For example, as a poppet valve opens and closes, the amplitude of vibration in the vibration trace would be expected to increase. If there are large increases in vibration amplitude at positions other than when the valve is expected to open and close, this may be indicative of a compressor problem. Of course, merely having a vibration trace correlated to a plunger position does not provide as much information as having the added benefit of a pressure profile, such as that generated by the system and method of the present invention.

A pressure profile, such as the pressure profile 104, shows the rise and fall of pressure in the cylinder as the plunger reciprocates. One skilled in the art will know that a well-functioning compressor generates a pressure profile having certain peaks and certain valleys, as well as certain slopes between the peaks and valleys. For example, when the pressure profile indicates that the cylinder takes too long to reach peak pressure, loses pressure too quickly, or does not reach a peak pressure that is high enough (just to name a few), a preventative maintenance plan can be implemented. Such a system is much more cost effective than waiting until a component, such as a poppet valve, fails during a production run.

It is worth noting that in addition to a vibration trace, generated along with a pressure profile, other compressor parameters may also be plotted on the same graph to generate different, or additional, cylinder pressure profiles. For example, the compressor parameters may be chosen from a set of compressor parameters which include volumetric efficiency of a compressor, a closing angle of the poppet valve, a machine loading, and an indicated horsepower. Each of these parameters may be correlated to the plunger position, such as the crank angle, so that their values may be coordinated with pressure values indicated by the pressure profile. Techniques for measuring these parameters are known in the art, and if the system is designed to send measurement signals to a data acquisition subsystem, such as the data acquisition subsystem 30, the preprogrammed algorithm may be modified to include additional compressor parameters along with the other information sent to the output device.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for monitoring the mechanical condition of a reciprocating compressor having a pressure-wrapped cylinder, the compressor including a plunger operable to reciprocate within the cylinder to cyclically compress a working fluid, thereby increasing the pressure of the fluid, an end assembly attached to one end of the cylinder, and at least one valve operable to facilitate fluid transfer between the cylinder and a source external to the cylinder, the method comprising:

measuring strain of at least one component of the end assembly as the plunger reciprocates within the cylinder, the at least one end assembly component experiencing a variable compressive force when the plunger reciprocates within the cylinder;

correlating the measured strain with a parameter related to plunger location, thereby facilitating generation of a strain profile; and determining first and second pressure values, the first and second pressure values being related to the pressure in the cylinder when the plunger is at first and second locations, respectively, the determination of the first and second pressure values facilitating generation of a cylinder pressure profile based on the correlated measured strain.

2. The method of claim 1, further comprising:

sensing vibrations of the at least one valve; and correlating the sensed vibrations with the parameter related to plunger location, thereby facilitating generation of a vibration profile.

3. The method of claim 1, wherein the strain is measured by a strain ring circumferentially disposed on the at least one end assembly component.

4. The method of claim 1, wherein the compressor further includes a crank assembly configured to cooperate with the plunger to transform rotational motion into linear motion of the plunger, the crank assembly including a crank rotatably connected to a crankshaft, and wherein the parameter related to plunger location is a crank angle.

5. The method of claim 1, wherein the first and second pressure values are determined when the plunger is at bottom dead center and top dead center, respectively.

6. The method of claim 5, wherein the compressor further includes a suction line for intaking the working fluid into the cylinder, and a discharge line for discharging the working fluid from the cylinder, the method further comprising:

measuring the pressure in the suction line;

measuring the pressure in the discharge line; and wherein the cylinder pressure when the plunger is at bottom dead center is assumed to be the suction line pressure, and the cylinder pressure when the plunger is at bottom dead center is assumed to be the discharge line pressure.

7. The method of claim 1, further comprising generating a cylinder pressure profile based on the correlated measured strain, the profile having one axis representing the cylinder pressure, and another axis representing the plunger location.

8. The method of claim 1, wherein the strain of two end assembly components is measured, and the method further comprises mathematically combining the two measured strains, thereby facilitating generation of a single strain profile for both measured strains.

9. The method of claim 1, wherein the end assembly includes a head at least partially disposed within the cylinder, the head being configured to facilitate fluid flow into the cylinder through the cylinder end, a flange, circumferentially disposed around a portion of the head and configured to retain the head at least partially within the cylinder, and a stud subassembly cooperating with the cylinder to retain the flange adjacent the cylinder end, and wherein the strain is measured on a portion of the stud subassembly.

10. The method of claim 1 further comprising:

determining at least one compressor parameter, chosen from a set of compressor parameters, the set of compressor parameters including volumetric efficiency of the compressor, a closing angle of the at least one valve, a machine loading, and an indicated horsepower; and correlating the at least one determined compressor parameter with the parameter related to plunger location, thereby facilitating generation of additional cylinder pressure profiles.

11. A system for using the method of claim 1, comprising:

a strain gauge configured to measure the strain of the at least one end assembly component and to output a signal related to the measured strain;

a first pressure sensor configured to measure pressure of the working fluid at a first location outside the cylinder, and to output a signal related to the measured pressure;

a second pressure sensor configured to measure pressure of the working fluid at a second location outside the cylinder, and to output a signal related to the measured pressure; and a data acquisition subsystem configured to receive signals from the strain gauge and the pressure sensors, and to apply a preprogrammed algorithm to the signals received, thereby facilitating generation of the strain profile and the working fluid pressure profile.

12. The system of claim 11, further comprising a vibration sensor configured to sense vibrations of the at least one valve and to output a signal related to the sensed vibrations to the data acquisition subsystem.

13. The system of claim 11, wherein the strain gauge includes a ring gauge circumferentially disposed on the at least one end assembly component.

14. The system of claim 11, wherein the compressor further includes a crank assembly configured to cooperate with the plunger to transform rotational motion into linear motion of the plunger, the crank assembly including a crank rotatably connected to a crankshaft, the system further comprising a subsystem for determining crank position and outputting a signal related to the crank position to the data acquisition subsystem.

15. The system of claim 14, wherein the subsystem includes a proximity probe configured to detect a discontinuity in the crankshaft, thereby facilitating a determination of the crank position.

16. The system of claim 14, wherein the subsystem includes a magnetic pickup configured to detect a magnetic device disposed on the crankshaft, thereby facilitating a determination of the crank position.

17. The system of claim 11, wherein the compressor further includes a suction line for intaking the working fluid into the cylinder, and a discharge line for discharging the working fluid from the cylinder, and wherein the first pressure sensor is configured to measure the pressure of the working fluid in the suction line, and the second pressure sensor is configured to measure the pressure of the working fluid in the discharge line.

18. The system of claim 17, wherein the data acquisition subsystem is configured to correlate the suction line pressure with the cylinder pressure when the plunger is at bottom dead center, and to correlate the discharge line pressure with the cylinder pressure when the plunger is at top dead center.

19. The system of claim 11, wherein the data acquisition subsystem is configured to generate a cylinder pressure profile based on the correlated measured strain, the profile having one axis representing the cylinder pressure, and another axis representing the plunger location.

20. The system of claim 11, wherein the data acquisition subsystem is further configured to correlate at least one compressor parameter, chosen from a set of compressor parameters, to the parameter related to plunger location, thereby facilitating generation of additional cylinder pressure profiles, the set of compressor parameters including volumetric efficiency of the compressor, a closing angle of the at least one valve, a machine loading, and an indicated horsepower.

* * * * *